US005685812A

United States Patent [19]

Seto et al.

[11] Patent Number: 5,685,812

[45] Date of Patent: Nov. 11, 1997

[54] TURRET PUNCH PRESS

[75] Inventors: Yoshiharu Seto; Shunzo Hirose, both of La Mirada, Calif.

[73] Assignee: Amada Mfg. America Inc., La Mirada, Calif.

[21] Appl. No.: 726,856

[22] Filed: Oct. 4, 1996

Related U.S. Application Data

[62] Division of Ser. No. 499,682, Jul. 7, 1995, Pat. No. 5,616,112.

[51] Int. Cl.[6] ..... B23Q 3/155; B21D 37/04

[52] U.S. Cl. ..... 483/29; 83/552; 83/563; 483/28

[58] Field of Search ..... 483/28, 29, 1; 83/552, 563, 559, 564; 72/442, 441; 29/33 J

[56] References Cited

U.S. PATENT DOCUMENTS

| | | | |
|---|---|---|---|
| 5,346,454 | 9/1994 | Hayashi | 483/29 |
| 5,522,295 | 6/1996 | Chun | 83/552 |
| 5,545,116 | 8/1996 | Seto | 483/29 |

FOREIGN PATENT DOCUMENTS

| | | | |
|---|---|---|---|
| 3066428 | 3/1991 | Japan | 483/29 |

*Primary Examiner*—William R. Briggs
*Attorney, Agent, or Firm*—Wigman, Cohen, Leitner & Myers, P.C.

[57] ABSTRACT

The turret punch press has a body frame (3); a ram (51) for striking a punch (41) to punch out work (W) in cooperation with a die (35); an upper turret (39) rotatably mounted on the body frame and having a plurality of punches (41), any desired punch being selectively located at a punch area (A1); and a lower turret (33) also rotatably mounted on the body frame and having a plurality of dies (35), any desired die mated with the desired punch being selectively located at the same punch area (A1). In particular, the upper turret (39) is formed smaller in diameter than the lower turret (33), and further the upper turret (39) is dislocated eccentrically from the lower turret (33) toward the punch area (A1) to provide an open die exchange area (A2) over a part of the lower turret (33). Or else, the upper turret (39) is formed with a cutout portion (53) to provide an open die exchange area (A2) over a part of the lower turret (33) when the upper turret is disposed concentrically on the upper turret (39). In addition, since a first die delivery device (85) is disposed on the body frame (3) and at the die exchange area (A2) to minimize the load applied to the die exchange arm (65), the die (35) can be moved by the die exchange arm to and from a die mount hole (37) of the lower turret (33) at high die exchange speed and precision, thus improving the die exchange efficiency.

8 Claims, 10 Drawing Sheets

TURRET PUNCH PRESS

This is a divisional of application Ser. No. 08/499,682, filed Jul. 7, 1995, U.S. Pat. No. 5,616,112.

BACKGROUND OF THE INVENTION

1. Field of the Invention

The present invention relates to a turret punch press, and more specifically to a die exchange section of a turret punch press for punching plate-shaped work.

2. Description of the Related Art

In the turret punch press, in general, a body frame is provided as a base, and a pair of disk-shaped upper turret and lower turret (both diameters are roughly equal to each other) are mounted on the body frame so as to be opposed to each other. On the upper turret, a number of exchangeable punches are arranged in a number of punch mount holes formed at regular angular intervals along the circumferential direction of the upper turret. Similarly, on the lower turret, a number of exchangeable dies are arranged in a number of die mount holes formed also at regular angular intervals along the circumferential direction of the lower turret. A desired mated pair of the punch and die is selected from among a number of pairs of the punches and dies, and the selected pair is located in a punching area. For the above-mentioned selection of the desired pair of the punch and die, a turret rotating servomotor is mounted for the upper turret and the lower turret, respectively.

Now, in the case of the upper turret, since the upper side of the upper turret is largely open, a punch fitted to a punch mount hole can be easily exchanged from above with the use of an appropriate automatic punch exchanging apparatus. In the case of the die, on the other hand, since the vertical clearance (i.e., gap) between the upper turret and the lower turret is relatively small, it is difficult to automatically exchange a die fitted to a die mount hole from above, with the result that the die is usually exchanged manually by a worker.

To overcome this problem, the same applicant has already proposed such a turret punch press that the upper turret is dislocated away from the die exchange area so that a die fitted to a die mount hole can be exchanged automatically from above by use of an automatic die exchanging apparatus, as disclosed in U.S. Ser. No. 08/006,941. This turret punch press is characterized in that the size of the upper turret is formed smaller than that of the lower turret and further the rotational axis of the upper turret is located near the side of the punching area, as compared with the rotational axis of the lower turret. In the turret punch press already proposed by the same applicant, however, a large load is inevitably applied to the die exchange arm, in addition to the weight of the die exchange arm. As a result, it is difficult to increase the rotational speed of the die exchange arm and thereby to improve the locating precision of the die exchange arm, thus resulting in a problem in that the die exchange work efficiency is lowered.

SUMMARY OF THE INVENTION

With these problems in mind, therefore, it is the object of the present invention to provide a turret punch press, which can exchange dies automatically in a high die exchange work efficiency.

To achieve the above-mentioned object, the first aspect of the present invention provides a turret punch press having a body frame (3) and a ram (51) for striking a punch (41) to punch out work (W) in cooperation with a die (35), comprising: a disk-like upper turret (39) rotatably mounted on the body frame, a plurality of punches (41) being exchangeably arranged in punch mount holes (43) at appropriate angular intervals in circumferential direction thereof, any desired punch being selectively located at a punch area (A1); a disk-like lower turret (33) also rotatably mounted on the body frame so as to be opposed to said upper turret, a plurality of dies (35) being exchangeably arranged in die mount holes (37) at appropriate angular intervals in circumferential direction thereof, any desired die mated with the desired punch being selectively located at the same punch area (A1); said upper turret (39) being formed smaller in diameter than said lower turret (33), and further said upper turret (39) being eccentrically dislocated from said lower turret (33) toward the punch area (A1) to provide an open die exchange area (A2) over a part of said lower turret (33); and first die delivering means (85) disposed on the body frame (3) and at the die exchange area (A2), for delivering a die (35) to and from the die mount hole (37) of said lower turret (33) in a vertical direction.

Further, the second aspect of the present invention provides a turret punch press having a body frame (3) and a ram (51) for striking a punch (41) to punch out work (W) in cooperation with a die (35), comprising: a disk-like upper turret (39) rotatably mounted on the body frame, a plurality of punches (41) being exchangeably arranged in punch mount holes (43) at appropriate angular intervals in circumferential direction thereof, any desired punch being selectively located at a punch area (A1); a disk-like lower turret (33) also rotatably mounted on the body frame so as to be opposed to said upper turret, a plurality of dies (35) being exchangeably arranged in die mount holes (37) at appropriate angular intervals in circumferential direction thereof, any desired die mated with the desired punch being selectively located at the same punch area (A1); said upper turret (39) being formed with a cutout portion (53) to provide an open die exchange area (A2) over a part of said lower turret (33) when said upper turret is disposed concentrically over said upper turret (39); and first die delivering means (85) disposed on the body frame (3) and at the die exchange area (A2), for delivering a die (35) to and from the die mount hole (37) of said lower turret (33) in a vertical direction.

Further, said first die delivering means (85) comprises: a pair of upper die exchange support (87) and lower die exchange support (89) located at the die exchange area (A2), for clamping any desired die (35) arranged in said lower turret therebetween in the vertical direction; and a pair of upper die exchange support moving device (93) and lower die exchange support moving device (97) also located at the die exchange area (A2), for driving said upper die exchange support and said lower die exchange support, respectively in the vertical direction, to clamp the die between said upper and lower die exchange supports and further to move the clamped die to and from said lower die turret (33) in the vertical direction.

Further, it is preferable that a plurality of said upper die exchange supports (87) and a plurality of said lower die exchange supports (89), and a plurality of said upper die exchange support moving device (93) and a plurality of said lower die exchange support moving device (97) are provided, respectively, so that an appropriate number of them can be used according to size of the die (35).

Further, it is preferable that the turret punch press further comprises: a disk-shaped die accommodate device (57) rotatably mounted on the body frame in the vicinity of said lower turret (33), a plurality of dies (35) being exchangeably arranged in die accommodate holes (55) at appropriate angular intervals in circumferential direction thereof, any desired die accommodate hole being selectively located at a die accommodate area (A3); second die delivering means (99) disposed on the body frame (3) and at the die accommodate area (A3), for delivering a die (35) to and from the die mount hole (55) of said die accommodate device (57) in the vertical direction; and a die exchange arm (65) rotatably mounted on the body frame between said lower turret (39) and said die accommodate device (57) so as to extend in a horizontal direction, said die exchange arm having a first die hold portion (71) and a second die hold portion (71) on both free ends thereof, respectively in such a way that when the first die hold portion (71) is located at the die exchange area (A2), the second die hold portion (71) is located at the die accommodate area (A3) or vice versa, the die (35) being exchanged from the mount hole (37) of said lower turret (33) to the mount hole (55) of said die accommodate device (57) or vice versa via said die exchange arm (65) and in cooperation of said first and second die delivering means (85, 99).

Further, it is preferable that said second die delivering means (99) comprises: a pair of upper die accommodate support (101) and lower die accommodate support (103) located at the die accommodate area (A3), for clamping any desired die (35) arranged in said die accommodate device (57) therebetween in the vertical direction; and a pair of upper die accommodate support moving device (107) and lower die accommodate support moving device (109) also located at the die accommodate area (A3), for driving said upper die accommodate support (101) and said lower die exchange support (103), respectively in the vertical direction, to clamp the die between said upper and lower die accommodate supports and further to move the clamped die to and from said die exchange arm (65) in the vertical direction.

Further, it is preferable that said die exchange arm (65) is provided with horizontal die clamping means for clamping the die in the horizontal direction on each free end thereof. The horizontal die clamping means comprises: at least one ball (77) disposed so as to project from an inner circumferential surface of the die hold portion (71) of said die exchange arm (65); and at least one spring (79) for urging said ball radially inward to engage said ball (77) with an outer circumferential groove (81) formed in the die (35). Or else, the horizontal die clamping means comprises: a pair of die clamp members (83) pivotally attached to the free end of said die exchange arm (65) to clamp the outer circumferential groove (81) formed in the die (35) as a pair of flat pliers.

As described above, in the turret punch press according to the present invention, the size of the upper turret is formed smaller than that of the lower turret, and further the rotary axle of the upper turret is offset from the rotary axle of the lower turret eccentrically toward the punch area A1. Or else, the upper turret is formed wlth a cutout portion at a part thereof at the die exchange area A2. Therefore, when the upper turret is disposed concentrically on the lower turret and further when the desired die mount hole is located at the die exchange area A2, the upper turret will not cover the die exchange area A2. As a result, since the desired die mount hole of the lower turret can be kept open largely at the die exchange area A2, it is possible to automatically exchange the any desired die mounted in any desired mount hole of the lower turret in the vertical direction with the use of the die exchange arm. In addition, when the die mounted in the die mount hole of the lower turret is exchanged manually, it is possible to facilitate the die exchange work and thereby to improve the die exchange work efficiency.

Further, when the die is exchanged at the die exchange area A2; that is, when the die is delivered from the die hold portion of the die exchange arm into the die mount hole of the lower turret or vice versa, since the first die delivery device (composed of the upper and lower die exchange supports and the upper and lower die exchange cylinders) is provided on the body frame, that is, since the first die delivery device is not mounted on the die exchange arm to minimize the load applied to the die exchange arm, it is possible to increase the die exchanging speed and to improve the die exchange precision of the die exchange arm. In addition, since any desired die can be delivered easily by clamping the die between the two die exchange supports and by moving the clamped die with the die exchange cylinders 93 in the vertical direction, it is possible to exchange the die easily without applying a large load to the die exchange arm. As a result, it is possible to reduce the load applied to the exchange arm and thereby to increase the rotational speed of the die exchange arm and the locating precision of the die exchange arm, thus resulting in an increase of the die exchange workability.

Further, at the die exchange area A2, the die can be securely fitted into the die mount hole of the lower turret by moving the upper die exchange support and the lower die exchange support together under the condition that the die is clamped between the two supports. In this case, since the number of the upper die exchange supports and the lower die exchange support are appropriately determined according to the size of the die, it is possible to further reliably exchange the dies.

DETAILED DESCRIPTION OF THE EMBODIMENTS

An embodiment of the turret punch press according to the present invention will be described hereinbelow with reference to the attached drawings.

Figure 1A:
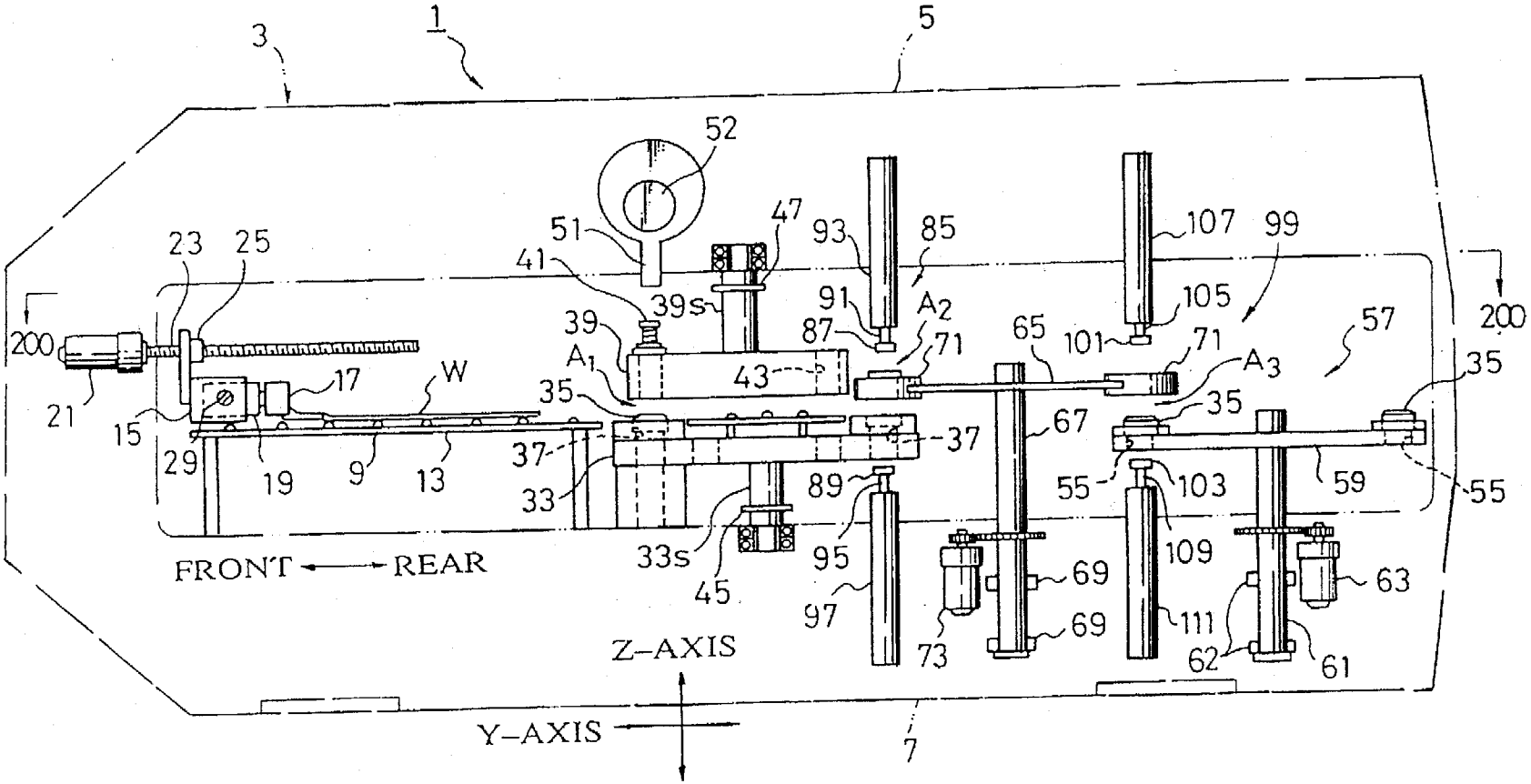
FIG. 1A is a side view showing a turret punch press according to the present invention.
Figure 1B:
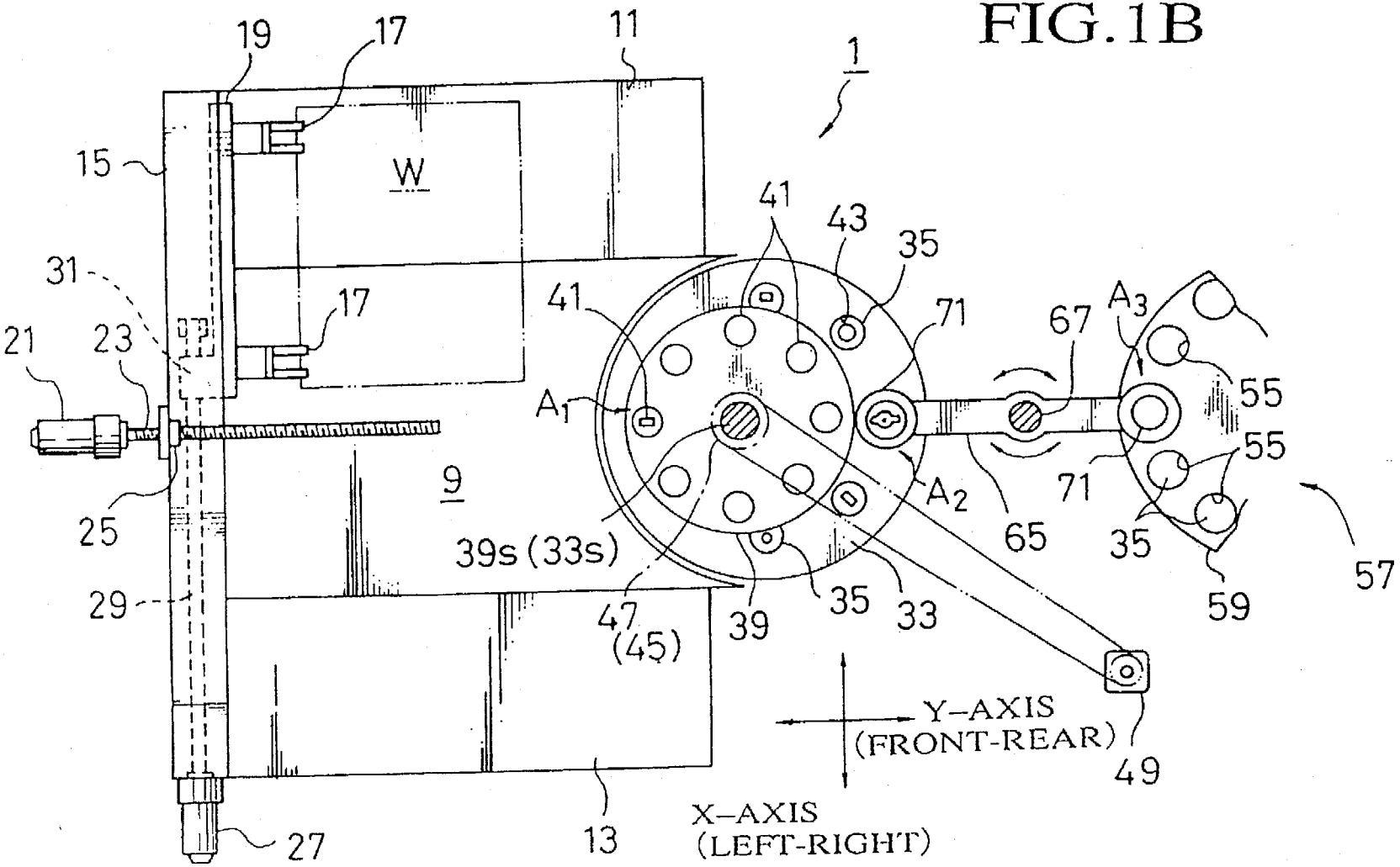
FIG. 1B is a cross-sectional view taken along the line 200—200 in FIG. 1A.

In FIGS. 1A and 1B, a turret punch press 1 according to the present invention is provided with a bridge-shaped body frame 3 as a base. The body frame 3 is formed with an upper frame 3 and a lower frame 7, when seen in the Z-axis (vertical) direction in FIG. 1A and a direction perpendicular to paper in FIG. 1B. A fixed table 9 is provided on the lower frame 7. Work W can be moved on the fixed table 9 in both X-axis (right and left) and Y-axis (front and rear) directions by two work moving mechanisms. That is, two movable tables 11 and 13 are moved in the Y-axis (front and rear) direction via the carriage base 15. On the other hand, the carriage 19 for clamping work W can be moved in the X-axis (right and left) direction along the carriage base 15. In more detail, a pair of the movable tables 11 and 13 are provided on both sides of the fixed table 9 fixed to the lower frame 7. On the front side of the movable tables 11 and 13, the carriage base 15 extending in the X-axis (right and left) direction is formed integral with the movable tables 11 and 13. On this carriage base 15, the carriage 19 having a work clamp 17 for clamping the front end of work W is attached so as to be movable in the X-axis direction. The carriage base 15 and a pair of the movable tables 11 and 13 can be moved together in the Y-axis (front and rear) direction by a Y-axis servomotor 21 mounted on the upper frame 5. A Y-axis ball screw 23 extending in the Y-axis direction is connected to the Y-axis servomotor 23, and further in mesh with a nut member 25 fixed to an appropriate position of the carriage base 15. Therefore, when the Y-axis servomotor 21 is driven, the carriage base 15 and a pair of the movable tables 11 and 13 can be moved in the Y-axis (front and rear) direction in FIGS. 1A and 1B. On the other hand, an X-axis servomotor 27 is mounted on the carriage base 15 to move the carriage 19 in the X-axis (right and left) direction. An X-axis ball screw 29 extending in the X-axis direction is connected to the X-axis servomotor 27, and further in mesh with a nut member 31 fixed to an appropriate position of the carriage 19. Therefore, when the X-axis servomotor 27 is driven, the carriage 19 for clamping the work W can be moved in the X-axis (right and left) direction in FIG. 1B.

On the rear side of the fixed table 9, a disk-shaped rotatable lower turret 33 is provided on the lower frame 7. The lower turret 33 is formed with a number of die mount (stepwise formed) holes 37 at appropriate angular intervals along the circumferential direction of the lower turret 33, so that a number of dies 35 can be exchangeably fitted to the die mount holes 37. In this connection, when the die 35 is fitted to the die mount hole 37 or after having fitted, the die 35 is fixed to the die mount hole 37 with a stop key to prevent the die 35 from being rotated therewithin.

In the same way, on the rear side of the fixed table 9, a disk-shaped rotatable upper turret 39 is provided on the upper frame 5 so as to face the lower turret 33. The upper turret 39 is formed with a number of punch mount (formed stepwise) holes 43 at appropriate angular intervals along the circumferential direction of the upper turret 39, so that a number of punch 41 can be exchangeably fitted to the punch mount holes 43.

To rotate both the lower turret 33 and the upper turret 39 to a predetermined punch (41) and die (35) processing area (referred to as punch area, hereinafter) A1, sprockets 45 and 47 (See FIGS. 1A and 1B) are attached to a rotary shaft 33*s* of the lower turret 33 and to a rotary shaft 39*s* of the upper turret 39, respectively. Each of these sprockets 45 and 47 are linked with a turret servomotor 49 by use of an appropriate chain, for instance as shown in FIG. 1B. In this case, the upper turret 39 and the lower turret 33 are driven in synchronism with each other by the turret servomotor 49. Without being limited thereto, however, it is also possible to rotate any one of the two turrets 33 and 39 separately by use of a clutch device.

At an appropriate position of the upper frame 5, a ram 51 for striking any selected punch 41 from above is provided. The ram 51 is of crank shaft type, for instance, in which the ram 51 can be moved in the vertical direction when a crankshaft 52 is rotated. Here, the punch area A1 implies a space and a position in or at which work W can be punched out.

In addition to the punch area A1, a die exchange area A2 is also provided a distance away from the punch area A1 in the rearward direction. Here, in order to prevent the upper turret 39 from being located within the die exchange area A2, the diameter of the upper turret 39 is formed smaller than that of the lower turret 33. In addition, the rotary axle 39*s* of the upper turret 39 is located eccentrically with respect to the rotary axle 33*a* of the lower turret 33 in such a way as to be offset away from the rotary axle 33*a* of the lower turret 33 toward the punch area A1.

Figure 2A:
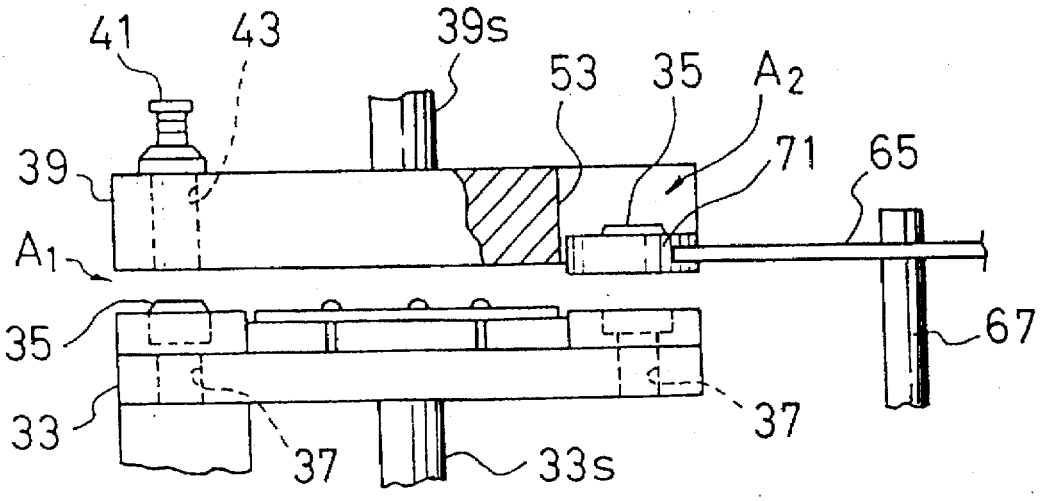
FIG. 2A is an enlarged side, partially broken view showing the upper turret of the turret punch press shown in FIG. 1A.
Figure 2B:
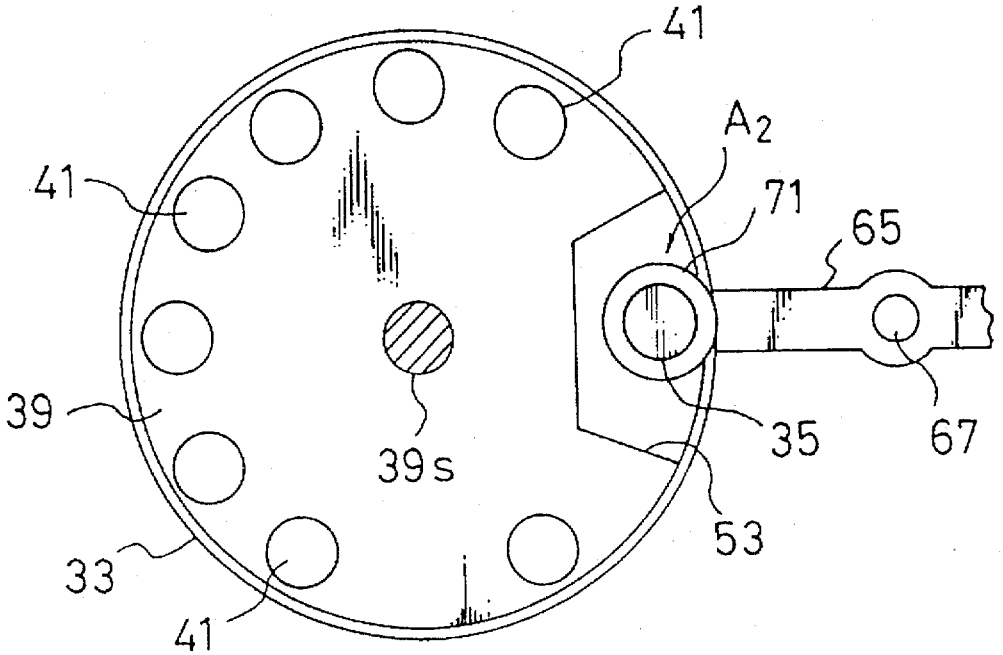
FIG. 2B is an enlarged top view showing the same upper turret shown in FIG. 2A.

Instead of the above-mentioned arrangement, when the diameter of the upper turret 39 is the same as that of the lower turret 33, as shown in FIGS. 2A and 2B, it is also possible to form a cutout 53 at a part of the upper turret 39 as a die exchange area A2, in such a way that whenever any desired die mount hole 37 is located at the die exchange area A2, the upper turret 39 will not cover the die exchange area A2 from above. Here, the die exchange area A2 implies a space or a position in or at which the die 35 mounted in the lower turret 33 can be exchanged with another die from above.

With reference to FIG. 1A and 1B again, on the rear side of the lower turret 33, a die accommodating device 57 having a number of die accommodate (stepwise formed) holes 55 for accommodating a number of dies 35, respectively is provided.

In more detail, on the rear side of the lower turret 33, a rotary pole 61 having a disk-shaped die accommodate member 59 is rotatably supported by the lower frame 7 via two bearing members 62. In the die accommodate member 59, a plurality of die accommodate holes 55 are formed at appropriate angular intervals along the circumferential direction thereof. To locate the angular position of the die accommodate member 59 to a die accommodate area A3, a die accommodate servomotor 63 is provided at an appropriate position of the lower frame 7. The accommodate servomotor 63 is linked with the rotary pole 61 of the die accommodate device 57 via a gear mechanism. In this connection, when the die 35 is fitted to the die accommodate hole 55 or after having fitted, the die 35 is fixed to the die accommodate hole 55 with a stop key to prevent the die 35 from being rotated therewithin.

Between the lower turret 33 and the die accommodate device 57, a rotary pole 67 having an exchange arm 65 is rotatably supported by the lower frame 7 via two bearing members 69. On both free ends of the exchange arm 65, a die hold portion 71 is provided, respectively to hold the die 35. The exchange arm 65 extends in the horizontal direction, and so constructed that when one free end of the die hold portion 71 is located on the die exchange area AS, the other free end of the die hold portion 71 is located on the die accommodate area A3, or vice versa. Here, the die accommodate area A3 implies a space or a position in or at which the die 35 can be moved from the die hold portion 71 of the die exchange arm 65 to the die accommodate hole 55 of the die accommodate device 57 or vice versa.

To locate the die hold portion 71 of the die exchange arm 65 at die exchange area A2 or the die accommodate area A3, an exchange servomotor 73 is provided at an appropriate position on the lower frame 7. The exchange servomotor 73 and the rotary pole 67 are linked via a gear mechanism.

Figure 3:
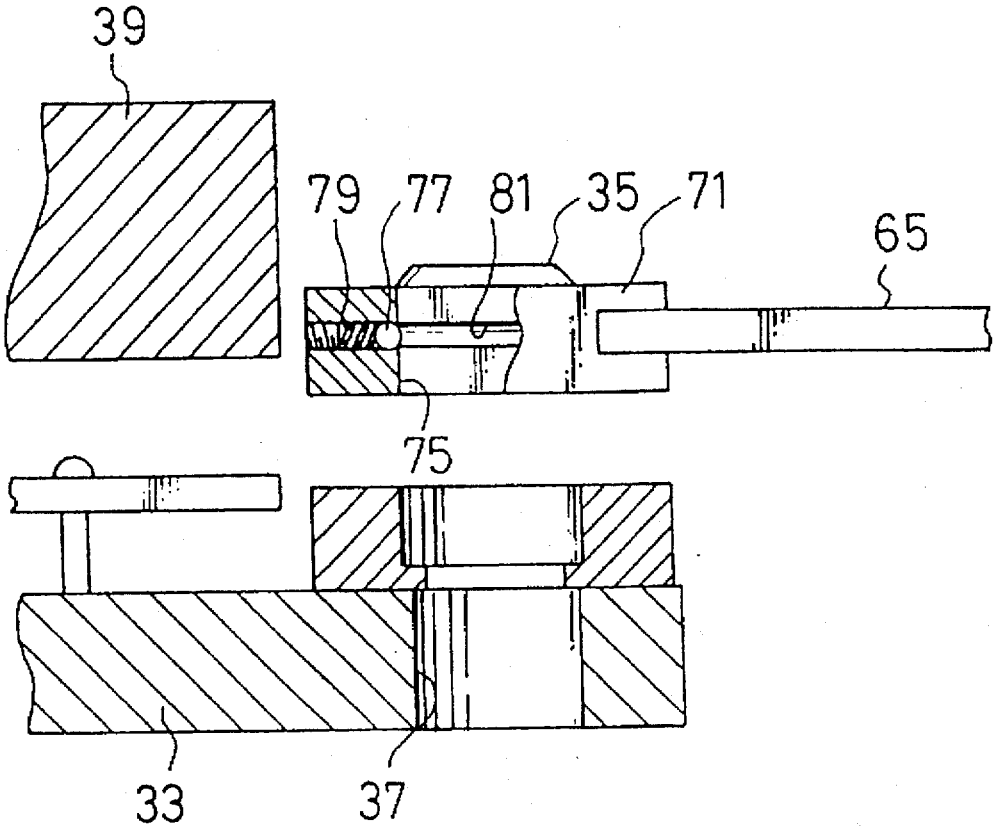
FIG. 3 is a view showing the detail of the die holding portion of the exchange arm.
Figure 4:
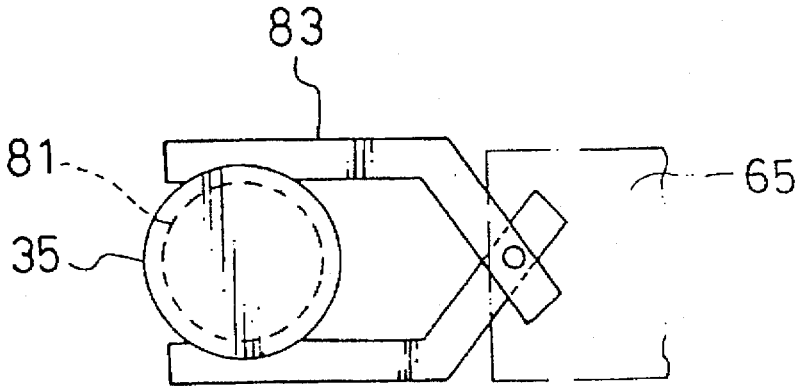
FIG. 4 is a view showing a modification of the die holding portion.
Figure 5B:
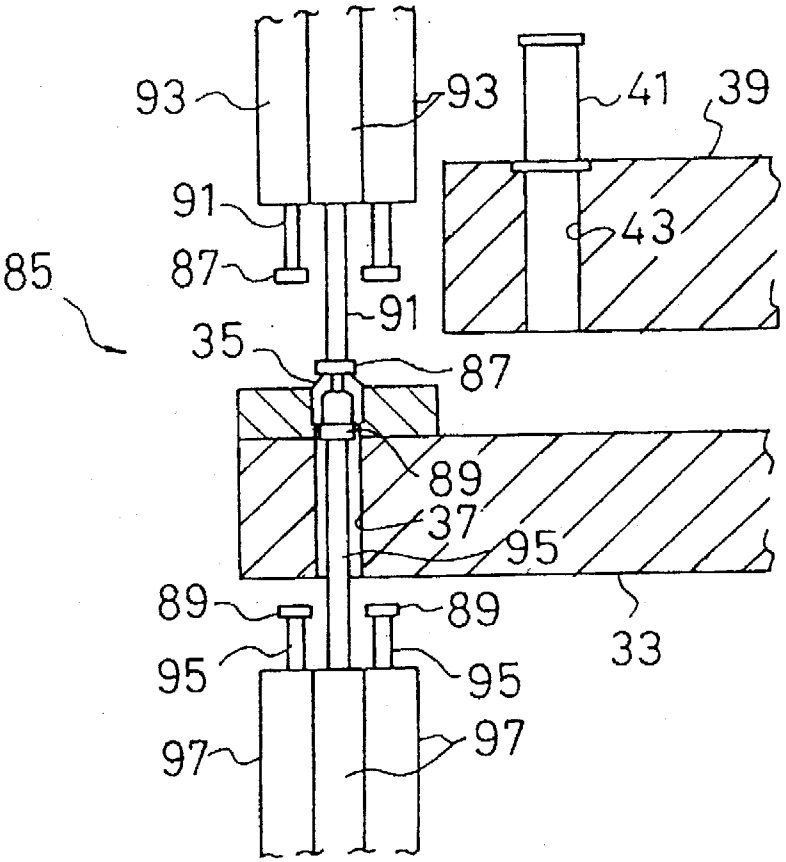
FIGS. 5A and 5B are views showing a plurality of upper die exchange supports and lower die exchange supports, in which a relatively small die is clamped in the vertical direction.
Figure 5A:
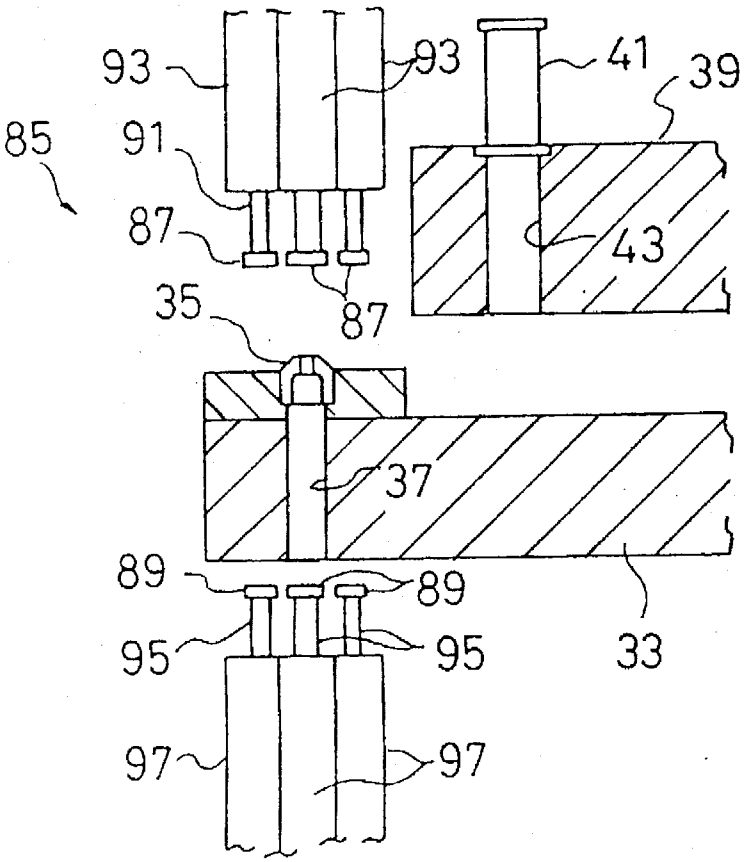
Figure 6B:
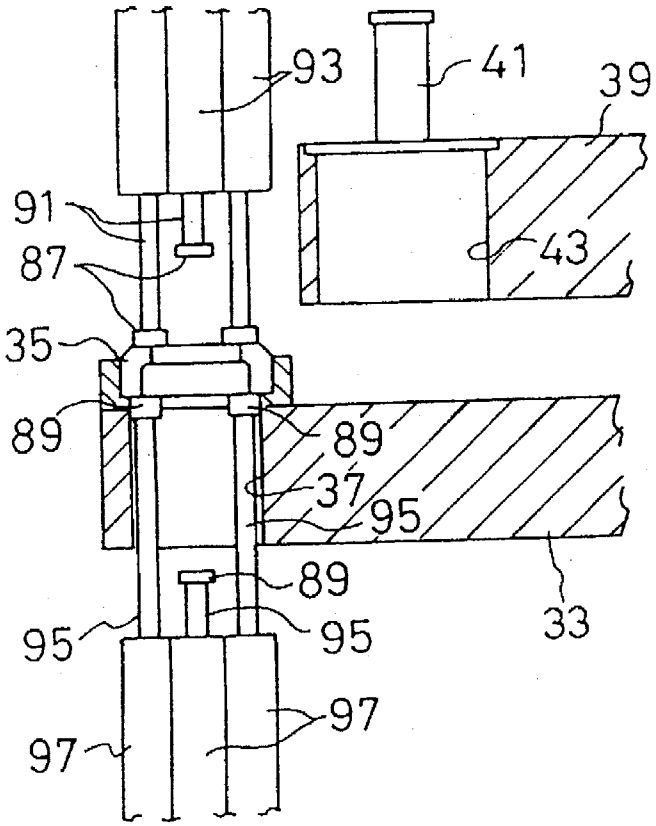
FIGS. 6A and 6B are views showing a plurality of upper die exchange supports and lower die exchange supports, in which a relatively large die is clamped in the vertical direction.
Figure 6A:
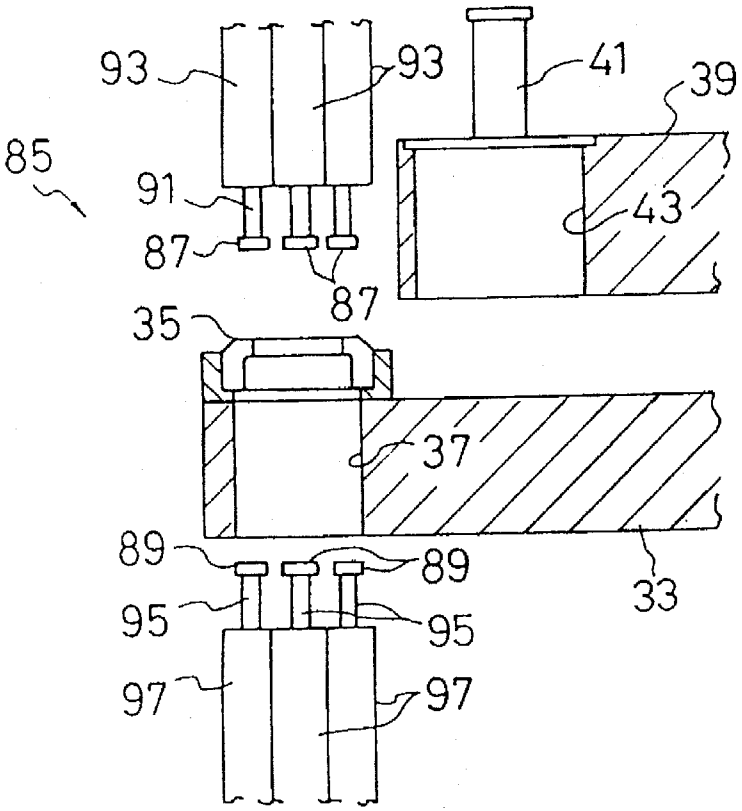

Further, as shown in FIG. 3, in order to hold the die 35 by the die hold portion 71 formed at each free end of the die exchange arm 65, the die hold portion 71 is formed with a die hold hole 75. Further, at least one ball 77 and a spring 79 are provided for each die hold portion 71 so that the ball 77 can be engaged with the outer circumferential groove 81 formed horizontally in the inner wall of the die hold hole 75. Further, when the die 35 is fitted to the die hold hole 75 or after having fitted, the die 35 is fixed to the die hold hole 75 with a stop key to prevent the die 35 from being rotated therewithin. Instead of this, as shown in FIG. 4, in order to hold the die 35 by each die hold portion 71, it is also possible to use a die clamper 83 of a pair of flat pliers for clamping the circumferential groove 81 of the die 35 from both the sides in the horizontal direction.

With reference to FIG. 1 again, in order to feed the die 35 from the die mount hole 37 of the lower turret 33 to the die hold portion 71 of the die exchange arm 65 or vice versa at the die exchange area A2, a die delivery device (die delivering means) 85 (at the die exchange area A2) is provided at an appropriate position of the body frame 3. The die delivery device 85 is provided with a pair of an upper die exchange support 87 and a lower die exchange support 89 for clamping the die 35 in the vertical direction at the die exchange area A2. To move the upper die exchange support 87 in the vertical direction, an upper die exchange cylinder (upper die exchange support moving device) 93 having a piston rod 91 movable in the vertical direction is provided at an appropriate position of the upper frame 5. The lower end portion of the piston rod 91 is attached to the upper die exchange support 87. In the same way, to move the lower die exchange support 89 in the vertical direction, an lower die exchange cylinder (lower die exchange support moving device) 97 having a piston rod 95 movable in the vertical direction is provided at an appropriate position of the lower frame 7. The lower end portion of the piston rod 95 is attached to the lower die exchange support 89. Here, in order to clamp various dies 35 of different sizes in the vertical direction, as shown in FIGS. 5A and 5B and FIGS. 6A and 6B, it is also preferable to provide a plurality of the upper die exchange supports 87, the lower die exchange supports 89, the upper die exchange cylinders 93, and the lower die exchange cylinders 97, respectively.

In order to feed the die 35 from the die mount hole 55 of the die accommodate device 57 to the die hold portion 71 of the die exchange arm 65 or vice versa at the die accommodate area A3, a second die delivery device (second die delivering means) 99 is provided at an appropriate position of the body frame 3. The die delivery device 99 is provided with a pair of an upper die accommodate support 101 and a lower die accommodate support 103 for clamping the die 35 in the vertical direction at the die accommodate area A3. To move the upper die accommodate support 101 in the vertical direction, an upper die accommodate cylinder (upper die accommodate support moving device) 107 having a piston rod 105 movable in the vertical direction is provided at an appropriate position of the upper frame 5. The lower end portion of the piston rod 105 is attached to the upper die accommodate support 101. In the same way, to move the lower die accommodate support 103 in the vertical direction, a lower die accommodate cylinder (the lower die accommodate support moving device) 111 having a piston rod 109 movable in the vertical direction is provided at an appropriate position of the lower frame 7. The lower end portion of the piston rod 109 is attached to the lower die accommodate support 103. Here, although not shown, in order to clamp various dies 35 of different sizes in the vertical direction, it is also preferable to provide a plurality of the upper die accommodate supports 101, the die lower accommodate supports 103, the upper die accommodate cylinders 107, and the lower die accommodate cylinders 111, respectively.

The operation of the turret punch press according to the present invention will be described hereinbelow.

When the plate-shaped work W is required to be punched out, the front end of the work W is clamped by the work clamp 17. After that, the Y-axis servomotor 21 is driven to move the carriage base 15 in the Y-axis (front and rear) direction. At the same time, the X-axis servomotor 27 is driven to move the carriage 19 in the X-axis (right and left) direction. That is, the work W can be moved in both the front and rear and the right and left directions at any desired position between the upper turret 39 and the lower turret 33.

Here, the turret servomotor 49 is driven to rotate the upper turret 39 and the lower turret 3 to locate (index) a desired pair of the punch 41 and the die 35 at the punch area A1. After that, the clank shaft 52 is rotated to move the ram 51 in the downward direction to punch the work W in cooperation of a desired pair of the punch 41 and the die 35.

By repeating the above-mentioned operation, it is possible to effect a series of punching processing to the work W.

When the used die 35 mounted in the die mount hole 37 of the lower turret 33 is required to be exchanged, the turret servomotor 49 is driven to rotate only the lower turret so that the die mount hole 37 of any desired die 35 is located at the die exchange area A2. In this embodiment, since the upper turret 39 is formed smaller in diameter than the lower turret 33 and further since the rotary axle 39*s* of the upper turret 39 is located toward the punch area A1 being offset eccentrically way from rotary axle 33*s* of the lower turret 33, the upper turret 39 is located way from the die exchange area A2, so that the upper space of the desired die mount hole 37 of the lower turret 33 can be kept open. Further, instead of rotating the lower turret 33 independently, it is also possible to rotate the lower turret 33 in synchronism with the upper turret 39.

Further, in the case of the turret punch press 1 in which the upper turret 39 is cut off partially so as to form a cutout portion 53 as shown in FIGS. 2A and 2B, the lower turret 33 is rotated independently to locate the desired die mount hole 37 at the die exchange area A2, and further the upper turret 39 is rotated also separately to locate the cutout portion 53 at the die exchange area A2. Under these conditions, the upper apace of the desired die mount hole 37 of the lower turret 33 can be kept open via the cutout portion 53 of the upper turret 39.

Figure 7A:
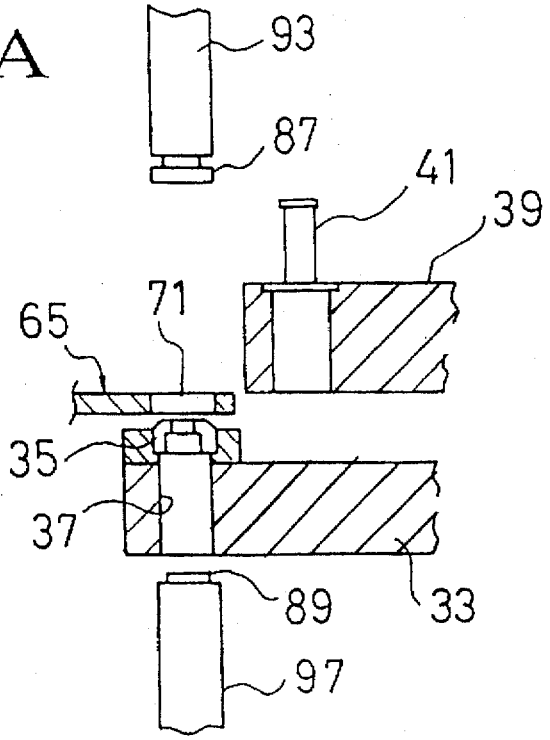
FIGS. 7A to 7H are illustrations for assistance in explaining the operation of the die exchange apparatus of the turret punch press according to the present invention.

Before or after the desired die mount hole 37 is located at the die exchange area A2, the exchange servomotor 73 is driven to rotate the exchange arm 65 in the horizontal direction in such a way that one of the die hold portion 71 of the exchange arm 65 is located on the die exchange area A2 and the other die hold portion 71 is located on the die accommodate area A3, respectively (as shown in FIG. 7A).

Figure 7B:
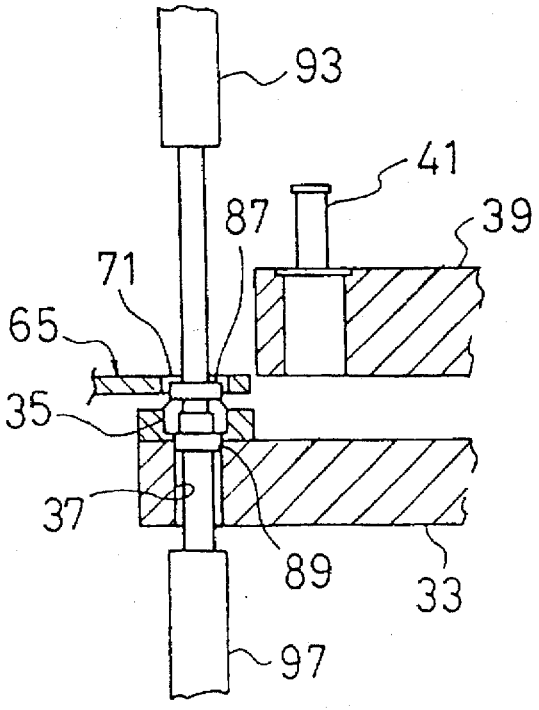

After the desired die mount hole 37 and one of the die hold portion 71 are located at the die exchange area A2, the upper die exchange cylinder 93 is driven to move the upper die exchange support 87 in the downward direction. At the same time, the lower die exchange cylinder 97 is driven to move the lower die exchange support 89 in the upward direction into the desired die mount hole 37. Therefore, a desired die 35 mounted in the desired die mount hole 37 of the lower turret 33 can be clamped between the upper die exchange support 87 and the lower die exchange support 89 in the vertical direction (as shown in FIG. 7B).

Figure 7C:
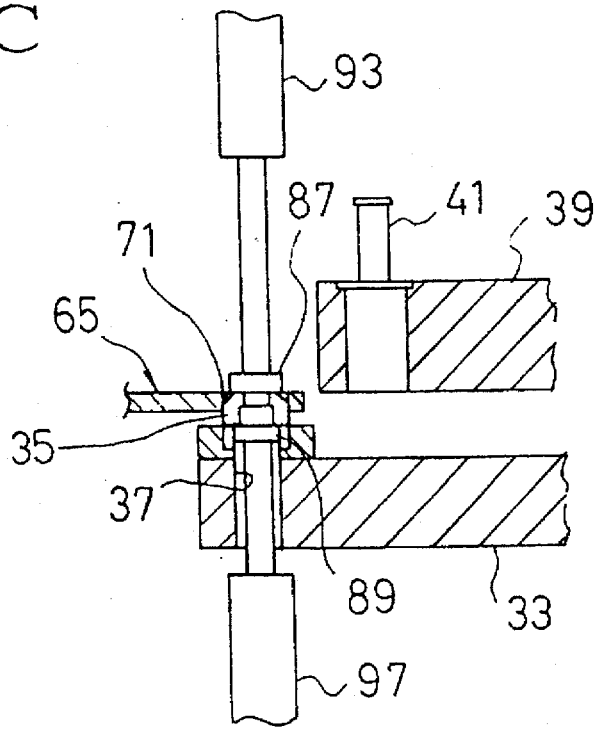

Under the conditions that the desired die 35 is clamped between the upper die exchange support 87 and the lower die exchange support 89, both the upper die exchange support 87 and the lower die exchange support 89 are moved upward together to move the desired die 35 away from the desired die mount hole 37 of the lower turret 33, so that the die 35 can be held by one of the die hold portion 71 (as shown in FIG. 7C).

Figure 7D:
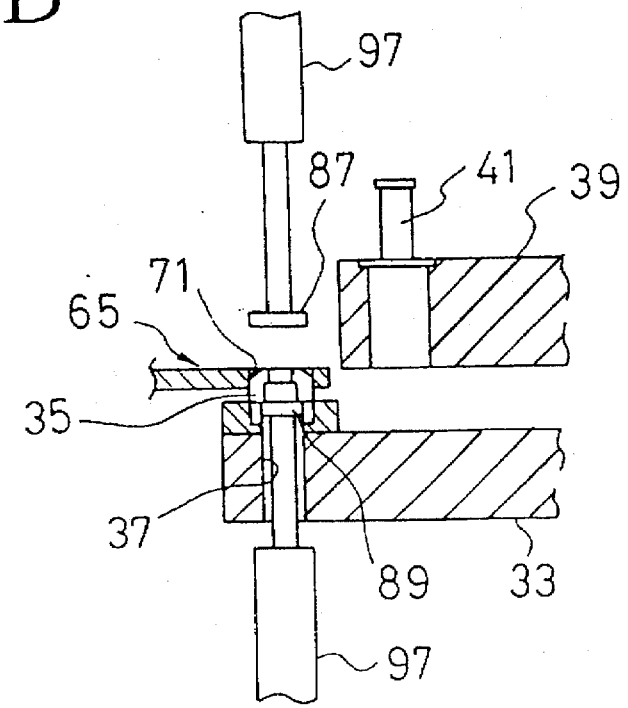

Further, after the desired die 35 has been held by one of the die hold portion 71, it is preferable to move the upper die exchange support 87 upward away from the exchange arm 65 (as shown in FIG. 7D).

Here, as shown in FIGS. 5A and 5B and FIGS. 6A and 6B, the above-mentioned operation is made by use of a plurality of upper die exchange supports 87 and the lower die exchange support 89 according to the size of the selected die 35. For instance, in the case shown in FIGS. 5A and 5B, since the size of the die 35 is relatively small, only middle upper, and lower die exchange supports 87 and 89 are used. On the other hand, in the case shown in FIGS. 6A and 6B, since the size of the die 35 is relatively large, two outer upper and lower die exchange supports 87 and 89 are used.

Before the desired die 35 is held by one of the die hold portion 71, for instance, during the punching processing, the accommodate servomotor 63 is driven to rotate the accommodate member 59 to locate the desired die accommodate hole 55 at the die accommodate area A3. Further, the upper die accommodate cylinder 107 is driven to move the upper die accommodate support 101 in the downward direction, and the lower die accommodate cylinder 111 is driven to move the lower die accommodate support 103 in the upward direction into the desired die accommodate hole 55. Therefore, another desired die 35A mounted in the desired die accommodate hole 55 can be clamped between the upper die accommodate support 101 and the lower die accommodate support 103 in the vertical direction. Under the conditions that the other desired die 35A is clamped between the upper die accommodate support 101 and the lower die accommodate support 103, both the upper die accommodate support 101 and the lower die accommodate support 103 are moved upward together to move the other desired die 35A away from the desired die mount hole 55, so that the other die 35A can be held by the other of the die hold portion 71. Further, after the other desired die 35A has been held by the other die hold portion 71, it is preferable to move the upper die accommodate support 101 upward away from the die hold portion 71.

Figure 7E:
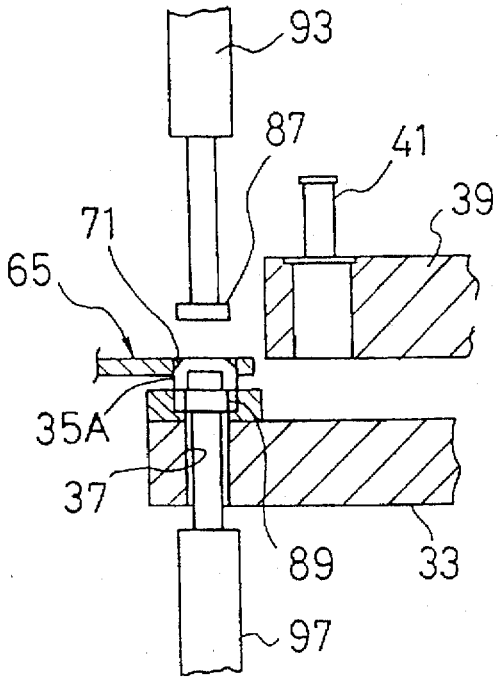

After the desired die 35 has been held by one of the die hold portion 71, the exchange arm 65 is rotated horizontally, to locate the one of the die hold portion 71 at the die accommodate area A3 and the other of the die hold portion 71 at the die exchange area A2, respectively (as shown in FIG. 7E).

Figure 7F:
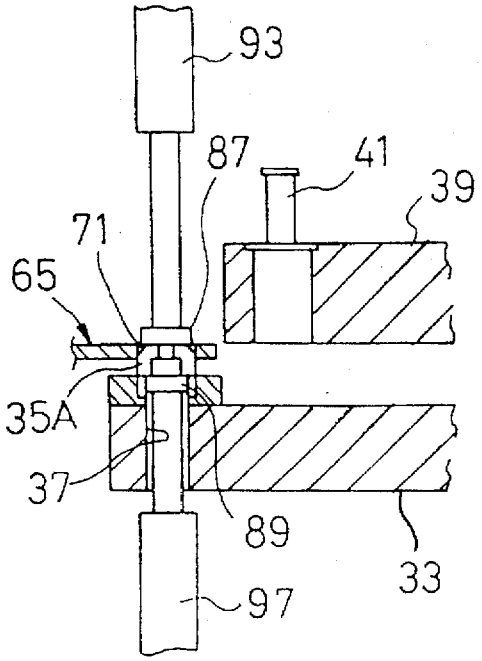

Further, at the die exchange area A2, the upper die exchange support 87 is moved in the downward direction and the lower die exchange support 89 is moved in the upward direction to clamp the other desired die 35A held by the other die hold portion 71 between the upper die exchange support 87 and the lower die exchange support 89 (as shown in FIG. 7F).

Figure 7G:
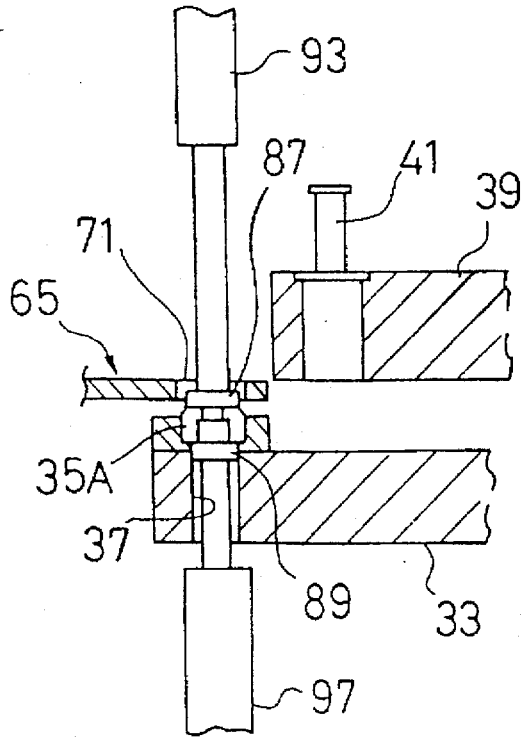
Figure 7H:
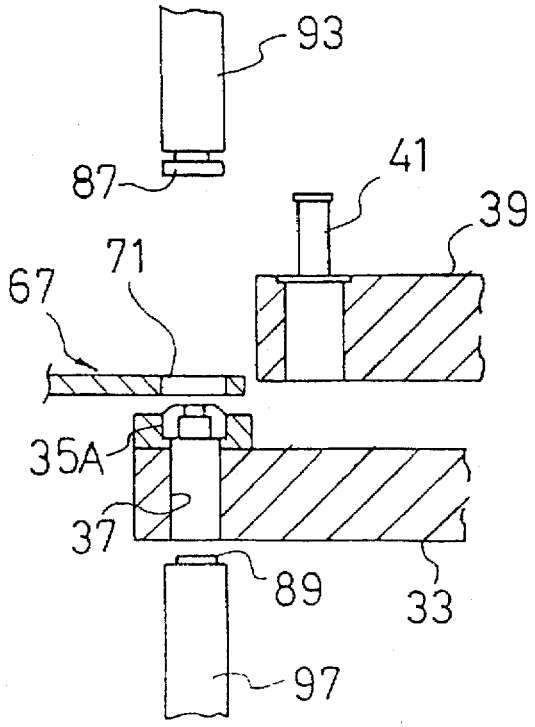

Under the condition that the other desired die 35A is clamped between the upper die exchange support 87 and the lower die exchange support 89, both the upper die exchange support 87 and the lower die exchange support 89 are moved together in the downward direction, to move the other desired die 35A from the other of the die hold portion 71 into a vacant die mount hole 37 (as shown in FIG. 7G). Further, after the other desired die 35A has been mounted in the vacant die mount hole 37, it is preferable to move the upper die exchange support 87 upward away from the die holder portion 71, as shown in FIG. 7H.

Further, at the die accommodate area A3, the upper die accommodate support 101 is moved in the downward direction and the lower die accommodate support 103 is moved in the upward direction to clamp the other desired die 35 held by one of the die hold portion 71 between the upper die accommodate support 101 and the lower die accommodate support 103.

Under the condition that the desired die 35 is clamped between the upper die accommodate support 101 and the lower die accommodate support 103, both the upper die accommodate support 101 and the lower die accommodate support 103 are moved together in the downward direction, to move the desired die 35 from the one of the die hold portion 71 into a vacant die mount hole 37.

By repeating the above-mentioned operation, it is possible to exchange a number of the dies 35 mounted on the respective die mount holes 37 of the lower turret 33 in the vertical direction.

As described above, in the turret punch press according to the present invention, the size of the upper turret 39 is formed smaller than that of the lower turret 33, and further the rotary axle **39*s* of the upper turret 39 is offset from the rotary axle 33*s* of the lower turret 33 eccentrically toward the punch area A1. Or else, the upper turret 39 is formed with a cutout portion 53 at a part thereof at the die exchange area A2. Therefore, when the upper turret 39 is disposed concentrically on the lower turret 33 and further when the desired die mount hole 37 is located at the die exchange area A2, the upper turret 39 will not cover the die exchange area A2. As a result, since the desired die mount hole 37 of the lower turret 33 can be kept open largely at the die exchange area A2, it is possible to automatically exchange the any desired die 35 mounted in any desired mount hole 37 of the lower turret 33 in the vertical direction with the use of the die exchange arm 65. In addition, when the die 35 mounted in the die mount hole 37 of the lower turret 33** is exchanged manually, it is possible to facilitate the die exchange work and thereby to improve the die exchange work efficiency.

Further, when the die 35 is exchanged at the die exchange area A2; that is, when the die 35 is delivered from the die hold portion 71 of the die exchange arm 65 into the die mount hole 37 of the lower turret 33 or vice versa, since the first die delivery device 85 (composed of the upper and lower die exchange supports 87 and 89 and the upper and lower die exchange cylinders 93 and 97) is provided on the body frame 3, that is, since the first die delivery device 85 is not mounted on the die exchange arm 65 to minimize the load applied to the die exchange arm 65, it is possible to increase the die exchanging speed and to improve the die exchange precision of the die exchange arm 65. In addition, since any desired die 35 can be delivered easily by clamping the die between the two die exchange supports 87 and 89 and by moving the clamped die 35 with the die exchange cylinders 93 and 97 in the vertical direction, it is possible to exchange the die 35 easily without applying a large load to the die exchange arm 65 (without additionally providing a die moving cylinder for moving the die 35 from the die hold portion 71 of the exchange arm 65 into the die mount hole 37 of the lower turret 33). As a result, it is possible to reduce the load applied to the exchange arm 65 and thereby to increase the rotational speed of the die exchange arm 65 and the locating precision of the die exchange arm 65, thus resulting in an increase of the die exchange workability.

Further, at the die exchange area A2, the die 35 can be securely fitted into the die mount hole 37 of the lower turret 33 by moving the upper die exchange support 87 and the lower die exchange support 89 together under the condition that the die 35 is clamped between the two supports 87 and 89. In this case, since the number of the upper die exchange supports 87 and the lower die exchange support 89 are appropriately determined according to the size of the die 35, it is possible to further reliably exchange the dies.

Further, in the above description, only the exchange of the die 35 has been explained in detail, without description of the exchange of the punch 41, because the exchange of the punch is not directly related to the gist of the present invention.

What is claimed is:

1. A turret punch press having a body frame (3) and a ram (51) for striking a punch (41) to punch out work (W) in cooperation with a die (35), comprising:

a disk-like upper turret (39) rotatably mounted on the body frame, a plurality of punches (41) being exchangeably arranged in punch mount holes (43) at appropriate angular intervals in circumferential direction thereof, any desired punch, being selectively located at a punch area (A1);

a disk-like lower turret (33) also rotatably mounted on the body frame so as to be opposed to said upper turret, a plurality of dies (35) being exchangeably arranged in die mount holes (37) at appropriate angular intervals in circumferential direction thereof, any desired die mated with the desired punch being selectively located at the same punch area (A1);

said upper turret (39) being formed with a cutout portion (53) to provide an open die exchange area (A2) over a part of said lower turret (33) when said upper turret is disposed concentrically over said lower turret (33); and first die delivering means (85) disposed on the body frame (3) and at the die exchange area (A2), for delivering a die (35) to and from the die mount hole (37) of said lower turret (33) in a vertical direction.

2. The turret punch press of claim 1, wherein said first die delivering means (85) comprises:

a pair of upper die exchange support (87) and lower die exchange support (89) located at the die exchange area (A2), for clamping any desired die (35) arranged in said lower turret therebetween in the vertical direction; and a pair of upper die exchange support moving device (93) and lower die exchange support moving device (97) also located at the die exchange area (A2), for driving said upper die exchange support and said lower die exchange support, respectively in the vertical direction, to clamp the die between said upper and lower die exchange supports and further to move the clamped die to and from said lower die turret (33) in the vertical direction.

3. The turret punch press of claim 2, wherein a plurality of said upper die exchange supports (87) and a plurality of said lower die exchange supports (89), and a plurality of said upper die exchange support moving device (93) and a plurality of said lower die exchange support moving device (97) are provided, respectively, so that an appropriate number of them can be used according to size of the die (35).

4. The turret punch press of claim 1, which further comprises:

a disk-shaped die accommodate device (57) rotatably mounted on the body frame in the vicinity of said lower turret (33), a plurality of dies (35) being exchangeably arranged in die accommodate holes (55) at appropriate angular intervals in circumferential direction thereof, any desired die accommodate hole being selectively located at a die accommodate area (A3);

second die delivering means (99) disposed on the body frame (3) and at the die accommodate area (A3), for delivering a die (35) to and from the die mount hole (55) of said die accommodate device (57) in the vertical direction; and a die exchange arm (65) rotatably mounted on the body frame between said lower turret (39) and said die accommodate device (57) so as to extend in a horizontal direction, said die exchange arm having a first die hold portion (71) and a second die hold portion (71) on both free ends thereof, respectively in such a way that when the first die hold portion (71) is located at the die exchange area (A2), the second die hold portion (71) is located at the die accommodate area (A3) or vice versa, the die (35) being exchanged from the mount hole (37) of said lower turret (33) to the mount hole (55) of said die accommodate device (57) or vice versa via said die exchange arm (65) and in cooperation of said first and second die delivering means (85, 99).

5. The turret punch press of claim 4, wherein said second die delivering means (99) comprises:

a pair of upper die accommodate support (101) and lower die accommodate support (103) located at the die accommodate area (A3), for clamping any desired die (35) arranged in said die accommodate device (57) therebetween in the vertical direction; and a pair of upper die accommodate support moving device (107), and lower die accommodate support moving device (109) also located at the die accommodate area (A3), for driving said upper die accommodate support (101) and said lower die exchange support (103), respectively in the vertical direction, to clamp the die between said upper and lower die accommodate supports and further to move the clamped die to and from said die exchange arm (65) in the vertical direction.

6. The turret punch press of claim 4, wherein said die exchange arm (65) is provided with horizontal die clamping means for clamping the die in the horizontal direction on each free end thereof.

7. The turret punch press of claim 6, wherein said horizontal die clamping means comprises:

at least one ball (77) disposed so as to project from an inner circumferential surface of the die hold portion (71) of said die exchange arm (65); and at least one spring (79) for urging said ball radially inward to engage said ball (77) with an outer circumferential groove (81) formed in the die (35).

8. The turret punch press of claim 6, wherein said horizontal die clamping means comprises: a pair of die clamp members (83) pivotally attached to the free end of said die exchange arm (65) to clamp the outer circumferential groove (81) formed in the die (35) as a pair of flat pliers.

* * * * *